United States Patent [19]

Ferguson et al.

[11] Patent Number: 4,940,092

[45] Date of Patent: Jul. 10, 1990

[54] WELL CLEAN OUT TOOL

[76] Inventors: Fred S. Ferguson, 23434 Wintergate Dr., Spring, Tex. 77373; Lonnie K. Perry, P.O. Box 914, Wink, Tex. 79789

[21] Appl. No.: 383,005

[22] Filed: Jul. 21, 1989

[51] Int. Cl.[5] ..... E21B 37/00

[52] U.S. Cl. ..... 166/311; 166/105.2; 166/105.3; 166/105.4

[58] Field of Search ..... 166/311, 105.1, 105.2, 166/105.3, 105.4

[56] References Cited

U.S. PATENT DOCUMENTS

| | | | |
|---|---|---|---|
| 1,423,935 | 7/1922 | Hopkins et al. | 166/105.2 |
| 1,684,295 | 9/1928 | Boyd et al. | 166/105.4 |
| 1,710,606 | 4/1929 | Brady | 166/105.3 X |
| 2,641,197 | 6/1953 | Stone | 166/105.4 X |
| 2,834,300 | 5/1958 | Brack | 166/105.2 X |
| 4,505,341 | 3/1985 | Moody et al. | 166/105.1 X |
| 4,621,693 | 11/1986 | Caldwel et al. | 166/311 |
| 4,711,299 | 12/1987 | Caldwell et al. | 166/311 X |

*Primary Examiner*—William P. Neuder
*Attorney, Agent, or Firm*—Kenneth A. Roddy

[57] ABSTRACT

A well clean out tool installed in a drill string is operable to pump sand and debris from the well bore. A pump portion includes an elongate pump barrel having apertures extending through its side wall at the upper end which is attached at its bottom end to one or more the debris-receiving and trapping subs and enclosed at its upper end by a top cap having a hexagonal opening. A hexagonal pump mandrel extends through the top cap and is connected to the bottom of the drill string by a top sub having apertures through its side wall whereby the pump barrel may be rotated with the drill string. A swab assembly contained within the pump barrel and connected to the bottom end of the pump mandrel is reciprocated thereby. The swab assembly includes a cruciform swab bypass mandrel having longitudinal fluid bypass channels with stop shoulders at each end thereof. One or more swab cups having internal metal sleeves ride on the exterior of the bypass mandrel.

On the down stroke, the swab bypass mandrel moves down relative to the swab cups to allow passage of fluid through the bypass channels and the apertures in the pump barrel and the valves in the lower subs close to capture sand and debris in the subs. On the up stroke, the bypass mandrel moves up and the lower swab cup closes off the bypass channels. As the swab assembly is raised relative to the pump barrel, the valves open allowing sand and debris to enter the lower subs and the fluids within the pump barrel are discharged are discharged through the pump barrel outlets.

19 Claims, 2 Drawing Sheets

WELL CLEAN OUT TOOL

BACKGROUND OF THE INVENTION

1. Field of the Invention

This invention relates generally to apparatus and methods of removing fluids, sand, and debris from the bottom of well bores, and more particularly to a downhole well clean out tool reciprocally and rotatably connected in a drill string and having a bypass swab assembly within a pump barrel above a debris receiving and trapping sub to capture sand and debris in the sub and discharge fluids through apertures in the pump barrel.

2. Brief Description of the Prior Art

Sand pumps and cleanout tools which remove sand and debris from wells are known in the art. Wire line sand pumps are lowered into a well bore on a wire line and are operated by reciprocating the wire line to operate a piston rod. Wire line sand pumps have limited motion due to the flexible wire line. Other types of sand pumps utilize a rigid string extending from the surface to impart rotary and reciprocating movement to the pump apparatus. Some sand pump devices provide for returning the pumped fluids to the well and others remove it entirely from the well by pumping it to the surface. There are several patents which disclose various cleanout tools and downhole pump apparatus for removing sand and debris from the well bore.

McFarlane, U.S. Pat. No. 2,224,916 discloses a well swab having a cruciform cross sectioned mandrel with vertical channels and a shoulder at each end. The mandrel is installed above a check valve which has a port communicating with the channels. A swab sleeve having a metal liner and a rubber exterior packer slides on the mandrel and seats at the lower end to close the port.

Read, U.S. Pat. No. 3,352,212 discloses well swab sealing devices having a plurality of upwardly facing unreinforced rings or flanges molded in spaced relationship about a metal tubular support, and are arranged to flex downwardly under a load of fluid and to flex further downward under a predetermined load of fluid to allow the by-pass of fluid about the edges of the flexible sealing flanges to dump the excess load.

Hamrick, U.S. Pat. No. 4,407,360 discloses a water pump which utilizes an inflatable packer and a conical sand trap.

Moody et al, U.S. Pat. No. 4,421,182 discloses a hydraulic clean-out and drilling tool. The lower assembly includes a debris chamber and a flapper trap valve.

Caldwell, U.S. Pat. Nos. 4,478,285 and 4,711,299 disclose apparatus for removing debris which include a hollow piston with a splined piston rod keyed to the pumping portion to transmit rotary motion to the lower debris retaining portion. A hollow piston head includes a ball valve to prevent downward flow of fluid. Liquid debris is passed through the interior of the piston and into the upper portion of the apparatus. The upper portion of the apparatus selectively receives a ported sub for recirculating the liquid back into the well or an unported sub which prevents return of the debris to the well.

Williams et al, U.S. Pat. No. 4,493,383 discloses a well clean out tool utilizing an inverted modified Bowen bumper sub which includes a piston with a hollow hexagonal piston tube plugged at the upper end and keyed to the pumping sub to transmit rotary motion to the lower debris retaining portion. The hollow piston includes a valve to control flow of fluid into the bore of the piston and piston tube and a plurality of unrestricted openings through the hollow wall of the piston and closely adjacent to the valve.

The present invention is distinguished over the prior art in general, and these patents in particular by a well clean out tool installed in a drill string above one or more debris-receiving and trapping subs. A pumping portion includes an elongate pump barrel attached at its bottom end to the upper debris trapping sub and has a top cap at its upper end with a hexagonal opening. The upper portion of the pump barrel has apertures through its side wall. A hexagonal pump mandrel extends through the top cap and is connected to the bottom of the drill string by a top sub having apertures through its side wall whereby the pump barrel may be rotated with the drill string. A swab assembly contained within the pump barrel is connected to the bottom end of the pump mandrel and reciprocated thereby. The swab assembly includes a swab bypass mandrel having a cruciform cross section forming longitudinal fluid bypass channels with stop shoulders at each end. One or more swab cups having internal metal sleeves ride on the exterior of the bypass mandrel and allow fluid circulation through the bypass channels in an upper position and in the lower lifting position close off circulation through the bypass channels and form a sliding fluid sealing relation with the interior surface of the pump barrel. A mule shoe sub, notched collar, drag bit, mill, or other suitable device may be installed at the bottom of the debris trapping subs to break up and/or penetrate the sand and debris at the bottom of the well bore.

After the clean-out tool is fully extended and on the downstroke, the swab bypass mandrel moves down relative to the swab cups to allow passage of fluid through the bypass channels and the apertures in the pump barrel and the sub connecting the pump barrel to the drill string to prevent hydraulic action of fluid inside the pump barrel and allow the valves in the debris-receiving and trapping sub to close and capture sand and debris in the sub. When the pump apparatus is on the up stroke, the bypass mandrel moves up, and the lower swab cup engages the lower stop shoulder and closes off the bypass channels and forms a sliding fluid sealing relation with the pump barrel interior. As the swab assembly is raised relative to the pump barrel, the valves in the debris-receiving and trapping subs open allowing sand and debris to enter the debris-receiving and trapping subs and the fluids within the pump barrel are discharged out through the fluid outlets near the top portion of the pump barrel.

SUMMARY OF THE INVENTION

It is therefore an object of the present invention to provide a downhole well clean out tool which will effectively dislodge and remove fluid, sand, and debris from a well bore.

It is another object of this invention to provide a downhole well clean out tool which may be rotated utilizing power tongs, a kelly, or a power swivel to dislodge and remove fluid, sand, and debris from a well bore.

Another object of this invention to provide a downhole well clean out tool which utilizes fluid in the well bore and may be operated when circulating the well with fluids, such as water is undesirable.

Another object of this invention is to provide a downhole well clean out tool which may be operated by raising and lowering the drill string 4–6 feet per stroke.

Another object of this invention is to provide a downhole well clean out tool which may be provided with a muleshoe sub, notched collar, drag bit, mill, or suitable device at its bottom end to break up, penetrate, or stir debris at the bottom of the well.

Another object of this invention is to provide a downhole well clean out tool utilizing debris-retaining and trapping subs at its lower end which catch and retain sand, and other debris that is suctioned up.

A further object of this invention is to provide a downhole well clean out tool having a by-pass swab assembly including swab cups which form a sealing relation with the interior of the pump barrel and which allows fluids to be circulated through the interior of the swab cups to the exterior of the pump barrel.

A still further object of this invention is to provide a downhole well clean out tool which is simple in construction, economical to manufacture, and rugged and reliable in use.

Other objects of the invention will become apparent from time to time throughout the specification and claims as hereinafter related.

The above noted objects and other objects of the invention are accomplished by a downhole well clean out tool which is installed in a drill string above one or more debris-receiving and trapping subs. A pumping portion includes an elongate pump barrel attached at its bottom end to the upper debris trapping sub and has a top cap at its upper end with a hexagonal opening. The upper portion of the pump barrel has apertures through its side wall. A hexagonal pump mandrel extends through the top cap and is connected to the bottom of the drill string by a top sub having apertures through its side wall whereby the pump barrel may be rotated with the drill string. A swab assembly contained within the pump barrel is connected to the bottom end of the pump mandrel and reciprocated thereby. The swab assembly includes a swab bypass mandrel having a cruciform cross section forming longitudinal fluid bypass channels with stop shoulders at each end. One or more swab cups having internal metal sleeves ride on the exterior of the bypass mandrel and allow fluid circulation through the bypass channels in an upper position and in the lower lifting position close off circulation through the bypass channels and form a sliding fluid sealing relation with the interior surface of the pump barrel. A mule shoe sub, notched collar, drag bit, mill, or other suitable device may be installed at the bottom of the debris trapping subs to break up and/or penetrate the sand and debris at the bottom of the well bore.

After the clean-out tool is fully extended and on the down stroke, the swab bypass mandrel moves down relative to the swab cups to allow passage of fluid through the bypass channels and the apertures in the pump barrel and the sub connecting the pump barrel to the drill string to prevent hydraulic action of fluid inside the pump barrel and allow the valves in the debris-receiving and trapping sub to close and capture sand and debris in the sub. When the pump apparatus is on the up stroke, the bypass mandrel moves up, and the lower swab cup engages the lower stop shoulder and closes off the bypass channels and forms a sliding fluid sealing relation with the pump barrel interior. As the swab assembly is raised relative to the pump barrel, the valves in the debris-receiving and trapping subs open allowing sand and debris to enter the debris-receiving and trapping subs and the fluids within the pump barrel are discharged out through the fluid outlets near the top portion of the pump barrel.

DESCRIPTION OF THE PREFERRED EMBODIMENT

Figure 1:
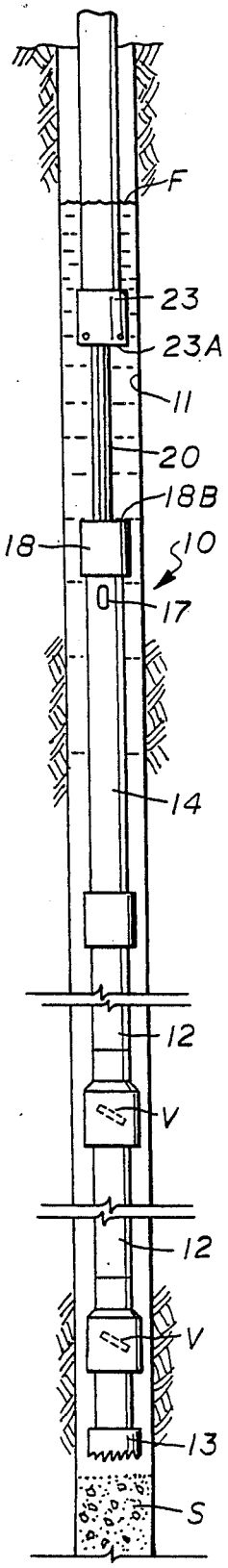
FIG. 1 is a schematic side elevation of a well clean out tool in accordance with the present invention within a well bore.

Referring to the drawings by numerals of reference, there is shown in FIG. 1 a preferred downhole well clean out tool 10 within a well bore 11. The pumping portion of the tool 10 is installed in a drill string above one or more debris-receiving and trapping subs or "saver subs" 12 having valve means V at the bottom end, such as conventional flapper or check valves. The well bore 11 has sand and other matter S at the bottom and is partially filled with a column of fluid F. The well clean out tool 10 preferably utilizes the fluid F in the well for its operation, however, it has been shown that the tool is capable of operating in air for limited periods of time. The debris-receiving and trapping subs or "saver subs" 12 are used to catch and retain sand, debris, metal bits, etc., suctioned up by the pump as explained hereinafter. A mule shoe sub, notched collar, drag bit, mill, or other suitable penetrating device 13 may be installed at the bottom of the lower saver sub 12 to break up, stir, or penetrate sand and debris at the bottom of the well.

The valves V are of conventional check valve or flapper valve design having a hinged flapper element slightly smaller in diameter than the interior diameter of the housing in which it is hingedly mounted and a valve disposed below the flapper element to sealingly engage the flapper in its seated position. The valves V are operated when the pump is stroked upward and the suction inside the recovery or trapping subs 12 (below the pumping portion 10) lifts the flapper elements off their seats and allows the fluid or debris to enter the subs 12. On the downstroke, the pressure equalizes and the valves close from their own weight.

Figure 2:
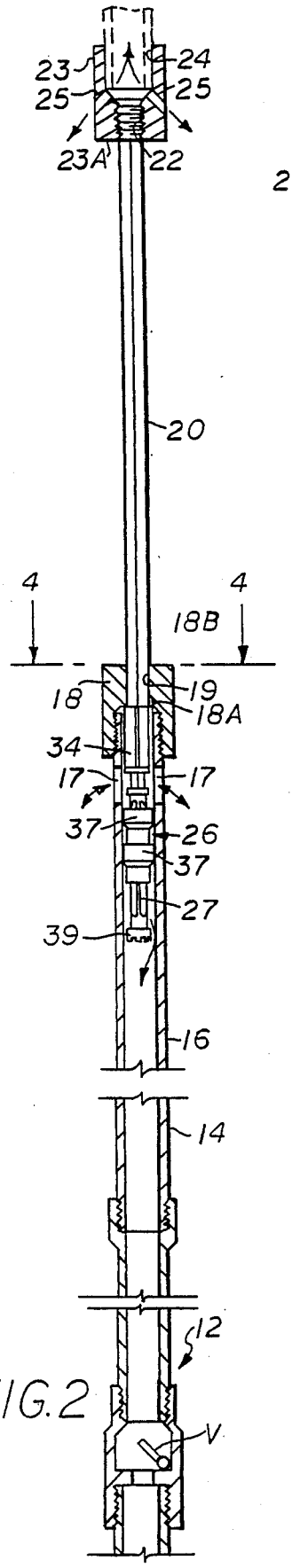
FIG. 2 is a side elevation of a portion of the well clean out tool in the extended position just prior to the down stroke.
Figure 4:
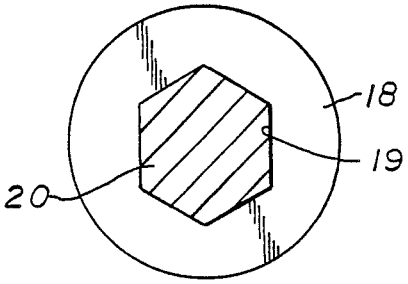
FIG. 4 is a transverse cross section through the hexagonal pump mandrel taken along line 4—4 of FIG. 2.
Figure 3:
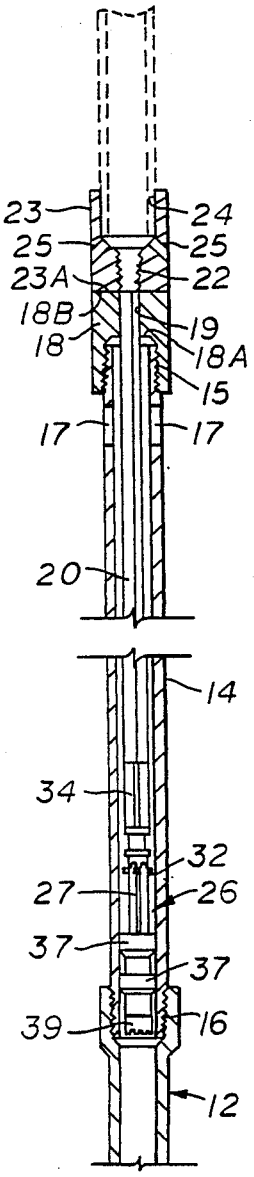
FIG. 3 is a side elevation of a portion of the well clean out tool in the contracted position just prior to the up stroke.
Figure 5:
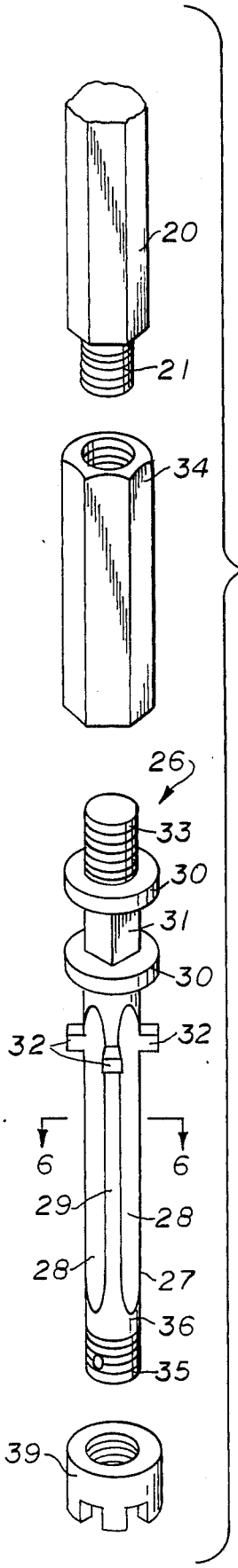
FIG. 5 is an exploded isometric view of the swab bypass mandrel, castle nut, knocker nut components at the bottom end of the hex mandrel.
Figure 6:
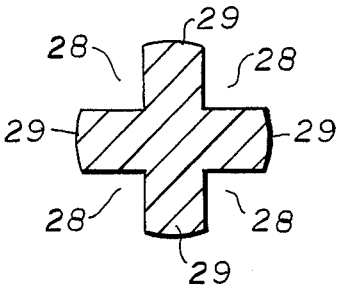
FIG. 6 is a transverse cross section through the swab bypass mandrel taken along line 6—6 of FIG. 5.
Figure 7:
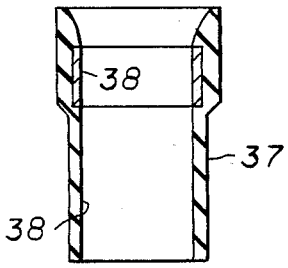
FIG. 7 is a longitudinal cross section through a swab cup member of the pump apparatus.

Referring additionally to FIGS. 2–4, the well clean out tool 10 comprises an elongate tubular pump barrel 14 having external threads 15 and 16 at the top and bottom ends. A series of circumferentially spaced ports 17 are formed through the side wall of the pump barrel 14 near the top end. The bottom end of the pump barrel 14 is threadedly received in the top of the upper saver sub 12. A top cap 18 having an internally threaded bottom and a hexagonal hole 19 in the top wall forming a shoulder 18A therebetween is threadedly installed on the threaded top end of the pump barrel 14.

Referring additionally to FIGS. 5-9, an elongate hexagonal pump mandrel 20 is slidably received through the hexagonal hole 19 in the top of the top cap 18. The hexagonal pump mandrel 20 has external threads 21 and 22 at its top and bottom ends. A top sub 23 having an internally threaded bottom end is threadedly received on the top end of the hexagonal pump mandrel 20. The top end of the top sub 23 is internally threaded 24 to receive the bottom joint of a drill string which extends to the surface. A series of circumferentially spaced drain holes 25 are formed through the side wall of the top sub 23 and extend angularly downward and outward from the interior to the exterior of the top sub.

The bottom surface 23A of the top sub 23 and the top surface 18B of the top cap 18 form opposed flat shoulders which may be brought forcefully together on the down stroke (FIG. 3) to force the penetrating device 13 into the sand and debris at the bottom of the well bore.

A swab assembly 26 is slidably received within the pump barrel 14. The swab assembly 26 comprises a swab bypass mandrel 27 cruciform in cross section to form longitudinal channels or passages 28 on its outer surface separated by longitudinally extending ribs 29. A pair of radial flanges 30 are formed on the upper end of the mandrel 27 and are spaced longitudinally apart by a wrench flat portion 31. A short distance below the lowermost flange 30 the rib portions 29 extend radially outwardly to form a series of circumferentially spaced stop shoulders 32.

The top end of the bypass mandrel 27 above the top flange 30 has a pin thread 33. The hexagonal pump mandrel 20 extends through the top cap 18 and a knocker nut 34 threadedly connects the bottom end of the pump mandrel 20 to the swab bypass mandrel 27. The knocker nut 34 is internally threaded at its top and bottom ends whereby the top end of the knocker nut is threadedly received on the threads 21 of the pump mandrel 21 and its bottom end is threadedly received on the pin threads 33 of the swab bypass mandrel 27.

The top surface of the knocker nut 34 may be forcefully brought into contact with the shoulder 18A in top cap 18 on the up stroke (FIG. 2) to jar the penetrating device 13 free from the sand and debris at the bottom of the well bore should it become stuck.

The bottom end of the swab bypass mandrel 27 has external threads 35 which terminate below the longitudinal channels 28 to leave a smooth cylindrical portion or sealing surface 36 on the exterior of the bypass mandrel below the channels.

One or more cylindrical swab cups 37 (FIG. 7) are slidably received on the bypass mandrel 27. A preferred swab cup 37 is formed of rubber or other suitable elastomeric material and has a central bore 38 with an internal metallic sleeve 38 disposed centrally within the bore. The interior lower end of the cup 37 surrounds the bypass mandrel 27 and the exterior diameter of the lower end is spaced radially inward from the interior of the side wall of the pump barrel 14. The interior upper portion of the cup extends angularly upward and outward and the exterior diameter of the upper portion is enlarged to slidably engage the interior of the side wall of the pump barrel 14. The top surface of the swab cup 37 will engage the stop shoulders 32 of the bypass mandrel. The cross sectional thickness of the swab cup is such that the enlarged diameter upper portion will flex outwardly to form a sealing relation with the pump barrel interior on the up stroke and will flex inwardly on the down stroke to slide relative to the pump barrel interior.

A castle nut 39 is threadedly received on the threads 35 at the bottom end of the bypass mandrel 27 and after the swab cup(s) are installed is secured thereon with a cotter pin (not shown) installed in a transverse hole 40 extending through the threaded portion 35. The castle nut 39 serves as a bottom stop for the swab cup(s) 37. In this manner, the swab cup 37 or cups are captured between the stop shoulders 32 at the top end and the castle nut 39 at the bottom end of the bypass mandrel.

The preferred pump barrel is approximately between seven and eight feet in length, and additional joints of tubing may be installed between the pump barrel 14 and the saver subs 12 depending upon the fluid level in the well bore. The sand pump barrel 14 preferably is maintained below the top surface of the column of fluid in order for the pump to operate most efficiently however, it has been shown that the tool is capable of operating in air for limited periods of time.

OPERATION

After the well clean out tool has been assembled, with one or more swab cups 37 on the bypass mandrel 27, the top sub 23 is installed on the tubing string, the apparatus is lowered into the well bore until the pump barrel 14 is below the top surface of the column of fluid. The apparatus may be lowered until the mule shoe sub, notched collar, drag bit, or mill 13 at the bottom of the apparatus reaches the sand or debris at the bottom of the well bore. The apparatus is in the extended position as it is lowered in the well bore and may be rotated as it is lowered or after reaching the sand or debris at the bottom of the well bore.

The hexagonal mandrel 20 extending through in the hexagonal hole 19 in the top cap 18 allows the assembly to be rotated as a complete unit. The assembly may be rotated by conventional means such as with power tongs, kelly, or power swivel. Rotating the apparatus will break up the sand and debris at the bottom of the well bore and allow it to be sucked into the saver subs more easily.

Figure 8:
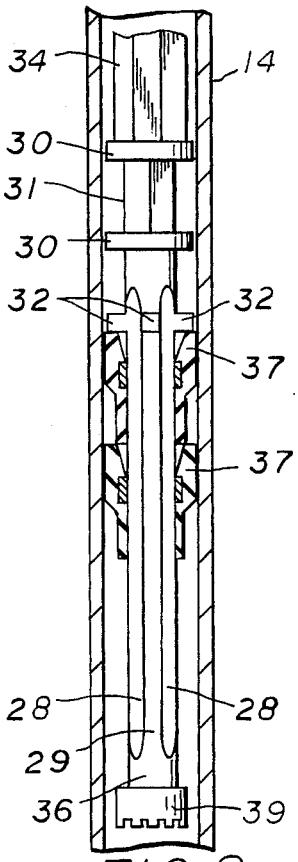
FIG. 8 is a partial cross section of the swab bypass mandrel with the swab cups in the down stroke position.

As shown in FIGS. 2 and 8, after the tool is fully extended and on the down stroke, the swab bypass mandrel 27 moves downward relative to the swab cups 37 and the swab cups are engaged by the mandrel stop shoulders 32. In this position, the bypass mandrel channels 28, the ports 17 at the top end of the pump barrel, and the ports 25 in the top sub 23, are all open and fluids circulate therethrough thus preventing hydraulic action of fluid inside the pump barrel.

Figure 9:
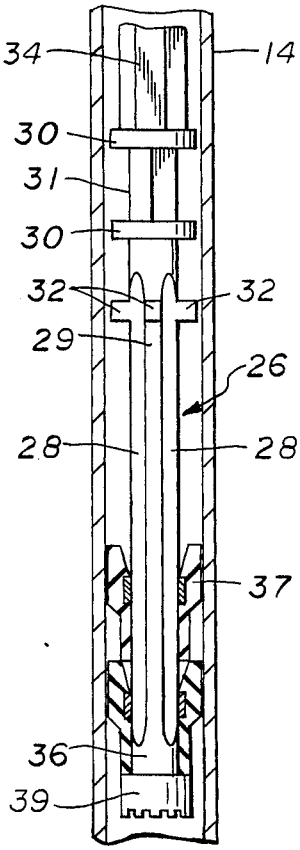
FIG. 9 is a partial cross section of the swab bypass mandrel with the swab cups in the up stroke position.

As shown in FIGS. 3 and 9, when the tool is on the up stroke, the swab bypass mandrel 27 moves upward relative to the swab cups 37 and the top of the castle nut 39 at the bottom end of the swab bypass mandrel 27 engages the bottom of the lowermost swab cup 37. In this position, the lower portion of the lowermost swab cup 37 is in a sealing relation with the sealing surface 36 on the exterior of the bypass mandrel 27 below the channels 28 and the enlarged diameter upper portion of the swab cup(s) 37 will flex outwardly to form a reciprocal fluid sealing relation with the interior of the pump barrel 14. As the bypass mandrel assembly 26 is raised relative to the pump barrel 14 fluids within the pump barrel are discharged or pumped out through the ports 17 at the top portion of the pump barrel.

The tool is operated by raising and lowering the tubing four to six feet and on the up stroke, the flapper or check valves in the saver subs 12 open allowing sand and debris to enter the saver subs, and on the down stroke, the flapper or check valves close to capture the sand and debris inside the saver subs.

The bottom surface 23A of the top sub 23 and the top surface 18B of the top cap 18 may be brought forcefully together on the down stroke (FIG. 3) to force the penetrating device 13 into the sand and debris at the bottom of the well bore. The top surface of the knocker nut may be forcefully brought into contact with the shoulder 18A in top cap 18 on the up stroke (FIG. 2) to jar the penetrating device 13 free from the sand and debris at the bottom of the well bore should it become stuck.

It should be noted that debris is not trapped in the pump portion 10, but in the subs and tubing run above and below the valves V. The amount of tubing used is determined by the estimated amount of debris believed to be in the well. In removing the debris, the working string is pulled from the well, the pump portion is unscrewed one joint at a time, allowing debris and fluid to fall out. Occasionally it may be necessary to strike the joint with a hammer to dislodge dryer, tightly packed debris. This is done until the entire debris trapping sub has been pulled and cleaned out, including the flapper valves V and any components that have been run below them, such as a mule shoe, notched collar, or drag bit.

While this invention has been described fully and completely with special emphasis upon a preferred embodiment, it should be understood that within the scope of the appended claims the invention may be practiced otherwise than as specifically described herein.

We claim:

1. A downhole well clean out tool for removing sand and debris from a well bore comprising:

an elongate string connectable to a source of reciprocating and rotating motion located at the surface, the string including;

at least one vertically extending debris-receiving and trapping sub positioned in said string having an outlet at the upper end thereof, and an inlet at the lower end thereof and at least one debris-trapping valve operatively positioned at the inlet end to open and close the inlet to said debris-receiving sub, an elongate tubular pump barrel connected at its lower end in fluid communication with the outlet of said debris-receiving and trapping sub and having fluid outlets through its side wall near its upper end and enclosed at its top end, an elongate vertically extending pump mandrel extending reciprocally through the enclosed top end of said pump barrel and keyed thereto to allow reciprocal vertical movement relative to said pump barrel while preventing rotational movement relative thereto whereby said pump barrel and said pump mandrel will rotate as a single unit upon rotation of said pump mandrel, a top sub member connected at its lower end to the top end of said pump mandrel and its top end adapted to be connected in fluid communication to a drill string extending to the surface of the well bore and having fluid outlets through its side wall near its lower end, a swab assembly reciprocally contained within said pump barrel including a swab bypass mandrel connected at its top end to the bottom end of said pump mandrel and having at least one longitudinal bypass channel on its circumference and axially spaced stop shoulders at each end of said bypass channel with a smooth cylindrical portion between the bottom end of said bypass channel and the lower stop shoulder, and at least one swab member slidable vertically on said bypass mandrel with the upper stop shoulder forming a stop for the swab member in its uppermost position and the lower stop shoulder forming a stop for the swab member in its lowermost lifting position, said swab member having an interior diameter configured to allow fluid circulation through said bypass channel in its uppermost position and in its lowermost lifting position to form a fluid sealing relation with said bypass mandrel smooth cylindrical portion to close off circulation through said bypass channel and having an exterior diameter configured to form a sliding fluid sealing relation with the interior surface of said pump barrel, whereby after the tool is fully extended and on the down stroke said swab bypass mandrel will move downward relative to said swab member engaging it with the upper stop shoulder to allow passage of fluid through said bypass mandrel channel and said pump barrel and said top sub fluid outlets to relieve hydraulic action of fluid inside said pump barrel and allow said debris-trapping valve to close and capture sand and debris in said debris-receiving and trapping sub, and when the tool is on the up stroke, said swab bypass mandrel moves upward relative to said swab member to engage said swab member with the lower stop shoulder in a sealing relation with said bypass mandrel smooth cylindrical portion below the channel and said swab member exterior diameter forms a sliding fluid sealing relation with said pump barrel interior surface and as said swab assembly is raised relative to said pump barrel causing hydraulic action to open said debris-trapping valve allowing sand and debris to enter said debris-receiving and trapping sub and the fluids within said pump barrel above said swab member to be discharged out through the fluid outlets near the top portion of said pump barrel.

2. A downhole well clean out tool according to claim 1 including penetrating means at the bottom end of the lowermost debris-receiving and trapping sub for penetrating and breaking up sand and debris at the lower portion of the well bore upon reciprocation and rotation of said debris-receiving and trapping sub.

3. A downhole well clean out tool according to claim 1 wherein said swab member comprises a cylindrical upwardly facing cup-shaped elastomeric member having a central bore which is slidably carried on said swab bypass mandrel and having an exterior diameter portion at its lower end spaced inwardly from the interior diameter of said pump barrel and an enlarged exterior diameter portion extending angularly upward and outward at its upper end to slidably engage the interior diameter of said pump barrel, and the upper end of said swab member being of sufficient thickness to flex outwardly to form a sliding fluid sealing relation with the interior diameter of said pump barrel on the up stroke and flex inwardly on the down stroke to slide relative to said pump barrel interior diameter.

4. A downhole well clean out tool according to claim 3 including a cylindrical metal sleeve within the central bore of said swab member for reinforcing the elastomeric material.

5. A downhole well clean out tool according to claim 1 in which said pump barrel comprises an elongate tubular member having threads at its bottom end threadedly connected to the outlet end of said debris-receiving and trapping sub and having threads at its top end, and a cylindrical cap member threadedly received on the top end of said pump barrel and having an end wall enclosing the top end of said pump barrel and having an axial hexagonal aperture therethrough defining an interior and exterior shoulder surrounding the aperture, said cap exterior shoulder forming a contraction stop shoulder to engage the bottom end of said top sub when said apparatus is in its fully contracted position.

6. A downhole well clean out tool according to claim 5 wherein said pump mandrel is a solid longitudinal rod having a hexagonal transverse cross section and threaded at each end, and said pump mandrel is slidably received through said cap hexagonal aperture.

7. A downhole well clean out tool according to claim 6 wherein said top sub member has a threaded bottom end threadedly connected to the top threaded end of said pump mandrel and the top end of said sub is internally threaded to receive the bottom threaded end of a joint of a drill string, and said top sub member fluid outlets comprise a plurality of circumferentially spaced holes extending downwardly and outwardly through its side wall to the exterior of said sub.

8. A downhole well clean out tool according to claim 6 wherein said swab bypass mandrel is a solid member cruciform in cross section defining circumferentially spaced longitudinal fluid bypass channels separated by longitudinally extending ribs and having a pair of radial flanges formed on its upper end which are spaced longitudinally apart by a wrench flat portion, said longitudinal ribs having radial outward extensions a short distance below the lowermost radial flange to define the upper stop shoulder on said swab bypass mandrel, and said mandrel having extension stop means on its top end to engage the interior shoulder of said cap member when said apparatus is in its fully extended position.

9. A downhole well clean out tool according to claim 8 wherein said swab bypass mandrel has external threads at its top end and is threadedly connected at its top end to the bottom end of said pump mandrel by an internally threaded knocker nut member within said pump barrel and said knocker nut serving as the extension stop means in the fully extended position, said swab bypass mandrel has external threads at its bottom end which terminate below the smooth cylindrical portion beneath said bypass channels, and a nut member is threadedly received on the threads at the bottom end of said bypass mandrel and removably secured thereon to form the lower stop shoulder of said swab bypass mandrel.

10. A downhole well clean out tool according to claim 9 wherein said swab member comprises a cylindrical upwardly facing cup-shaped elastomeric member having a central bore which is slidably carried on said swab bypass mandrel and having an exterior diameter portion at its lower end spaced inwardly from the interior diameter of said pump barrel and an enlarged exterior diameter portion extending angularly upward and outward at its upper end to slidably engage the interior diameter of said pump barrel, and the upper end of said swab member being of sufficient thickness to flex outwardly to form a sliding fluid sealing relation with the interior diameter of said pump barrel on the up stroke and flex inwardly on the down stroke to slide relative to said pump barrel interior diameter.

11. A downhole well clean out tool according to claim 10 including a cylindrical metal sleeve within the central bore of said swab member for reinforcing the elastomeric material.

12. A downhole well clean out tool according to claim 1 including one or more sections of hollow tubing installed between said pump barrel and said debris-receiving and trapping subs.

13. In a reciprocating and rotating downhole well clean out tool having a vertically extending debris-receiving and trapping sub with an outlet at its upper end and an inlet at its lower end thereof and a debris-trapping valve operatively positioned at the inlet end to open and close the inlet to the debris-receiving sub, a pump apparatus comprising:

an elongate tubular pump barrel connectable at its lower end in fluid communication with the outlet of said debris-receiving and trapping sub and having fluid outlets through its side wall near its upper end and enclosed at its top end, an elongate vertically extending pump mandrel extending reciprocally through the enclosed top end of said pump barrel and keyed thereto to allow reciprocal vertical movement relative to said pump barrel while preventing rotational movement relative thereto whereby said pump barrel and said pump mandrel will rotate as a single unit upon rotation of said pump mandrel, a top sub member connected at its lower end to the top end of said pump mandrel and its top end adapted to be connected in fluid communication to a drill string extending to the surface of the well bore and having fluid outlets through its side wall near its lower end, and a swab assembly reciprocally contained within said pump barrel including a swab bypass mandrel connected at its top end to the bottom end of said pump mandrel having at least one longitudinal bypass channel on its circumference and axially spaced stop shoulders at each end of said bypass channel with a smooth cylindrical portion between the bottom end of said bypass and the lower stop shoulder, and at least one swab member slidable vertically on said bypass mandrel with the upper stop shoulder forming a stop for the swab member in its uppermost position and the lower stop shoulder forming a stop for the swab member in its lowermost lifting position, said swab member having an interior diameter configured to allow fluid circulation through said bypass channel in its uppermost position and in its lowermost lifting position to form a fluid sealing relation with said bypass mandrel smooth cylindrical portion to close off circulation through said bypass channel and having an exterior diameter configured to form a sliding fluid sealing relation with the interior surface of said pump barrel, whereby after said apparatus is fully extended and on the down stroke said swab bypass mandrel will move downward relative to said swab member engaging it with the upper stop shoulder to allow passage of fluid through said bypass mandrel channel and said pump barrel and said top sub fluid outlets to relieve hydraulic action of fluid inside said pump barrel and allowing said debris-trapping valve to close and capture sand and debris in said debris-receiving and trapping sub, and when said apparatus is on the up stroke, said swab bypass mandrel moves upward relative to said swab member to engage said swab member with the lower stop shoulder in a sealing relation with said bypass mandrel smooth cylindrical portion below the channel and said swab member exterior diameter forms a sliding fluid sealing relation with said pump barrel interior surface and as said swab assembly is raised relative to said pump barrel causing hydraulic action to open said debris-trapping valve allowing sand and debris to enter said debris-receiving and trapping sub and the fluids within said pump barrel above said swab member to be discharged out through the fluid outlets near the top portion of said pump barrel.

14. The pump apparatus according to claim 13 in which said swab member comprises a cylindrical upwardly facing cup-shaped elastomeric member having a central bore which is slidably carried on said swab bypass mandrel and having an exterior diameter portion at its lower end spaced inwardly from the interior diameter of said pump barrel and an enlarged exterior diameter portion extending angularly upward and outward at its upper end to slidably engage the interior diameter of said pump barrel, and the upper end of said swab member being of sufficient thickness to flex outwardly to form a sliding fluid sealing relation with the interior diameter of said pump barrel on the up stroke and flex inwardly on the down stroke to slide relative to said pump barrel interior diameter.

15. The pump apparatus according to claim 13 in which said pump barrel is enclosed at its upper end by an end cap having an axial hexagonal aperture through its top wall defining an interior and exterior shoulder surrounding the aperture, and said pump mandrel is a solid longitudinal rod slidably received through said end cap hexagonal aperture and has external threads at each end, said cap exterior shoulder forming a contraction stop shoulder to engage the bottom end of said top sub when said apparatus is in its fully contracted position.

16. The pump apparatus according to claim 15 in which said swab bypass mandrel is a solid member cruciform in cross section defining circumferentially spaced longitudinal fluid bypass channels separated by longitudinally extending ribs and having a pair of radial flanges formed on its upper end which are spaced longitudinally apart by a wrench flat portion, said longitudinal ribs having radial outward extensions a short distance below the lowermost radial flange to define the upper stop shoulder on said swab bypass mandrel, and said swab bypass mandrel having extension stop means on its top end to engage the interior shoulder of said end cap member when said apparatus is in its fully extended position.

17. The pump apparatus according to claim 16 in which said swab bypass mandrel has external threads at its top end and is threadedly connected at its top end to the bottom end of said pump mandrel by an internally threaded knocker nut member within said pump barrel and said knocker nut serving as the extension stop means when said apparatus is in the fully extended position, said swab bypass mandrel has external threads at its bottom end which terminate below the smooth cylindrical portion beneath said bypass channels, and a nut member is threadedly received on the threads at the bottom end of said bypass mandrel and removably secured thereon to form the lower stop shoulder of said swab bypass mandrel.

18. The pump apparatus according to claim 17 in which said swab member comprises a cylindrical upwardly facing cup-shaped elastomeric member having a central bore which is slidably carried on said swab bypass mandrel and having an exterior diameter portion at its lower end spaced inwardly from the interior diameter of said pump barrel and an enlarged exterior diameter portion extending angularly upward and outward at its upper end to slidably engage the interior diameter of said pump barrel, and the upper end of said swab member being of sufficient thickness to flex outwardly to form a sliding fluid sealing relation with the interior diameter of said pump barrel on the up stroke and flex inwardly on the down stroke to slide relative to said pump barrel interior diameter.

19. A method of removing sand and debris from the lower end of a well bore having a column of fluid above the sand and debris, comprising the steps of:

installing at the lower end of a string of tubing at least one vertically extending debris-receiving and trapping sub having an outlet at its upper end and an inlet at its lower end, a sand and debris penetrating device at its bottom end, and at least one debris-trapping valve operatively positioned at the inlet end to open and close the inlet to the debris-receiving sub, installing an elongate tubular pump barrel in the tubing string with its lower end in fluid communication with the outlet of said debris-receiving and trapping sub, said pump barrel having fluid outlets through its side wall near its upper end and enclosed at its top end and an elongate vertically extending pump mandrel extending reciprocally through the enclosed top end of said pump barrel and keyed thereto to allow reciprocal vertical movement relative to said pump barrel while preventing rotational movement relative thereto whereby said pump barrel and said pump mandrel will rotate as a single unit upon rotation of said pump mandrel, said pump barrel having a swab assembly reciprocally contained therein including a swab bypass mandrel connected at its top end to the bottom end of said pump mandrel and having at least one longitudinal bypass channel on its circumference and axially spaced stop shoulders at each end of said bypass channel with a smooth cylindrical portion between the bottom end of said bypass channel and the lower stop shoulder, and at least one swab member slidable vertically on said bypass mandrel with the upper stop shoulder forming a stop for the swab member in its uppermost position and the lower stop shoulder forming a stop for the swab member in its lowermost lifting position, and said swab member having an interior diameter configured to allow fluid circulation through said bypass channel in its uppermost position and in its lowermost lifting position to form a fluid sealing relation with said bypass mandrel smooth cylindrical portion to close off circulation through said bypass channel and having an exterior diameter configured to form a sliding fluid sealing relation with the interior surface of said pump barrel, connecting the upper end of said pump mandrel to a string of tubing extending to the surface of the well bore and connecting the upper portion of said string of tubing to a source of reciprocating and rotating motion located at the surface, lowering said string of tubing into the well bore with said pump mandrel fully extended until said pump barrel and said debris-receiving and trapping sub are submerged within the column of fluid and said penetrating device is contacting the sand and debris at the lower end of the well bore, lowering said string of tubing further down to cause said pump mandrel and said swab assembly to move downward relative to said pump barrel and to cause said swab bypass mandrel to move downward relative to said swab member and engage the upper stop shoulder to allow passage of fluid through said bypass mandrel channel and said pump barrel and said top sub fluid outlets to relieve hydraulic action of fluid inside said pump barrel and allow said debris-trapping valve to close and capture sand and debris within said debris-receiving and trapping sub, and raising said string of tubing up to cause said pump mandrel to move upward relative to said pump barrel and to said swab member to engage said swab member on the lower stop shoulder in a sealing relation with said bypass mandrel smooth cylindrical surface and a sliding fluid sealing relation with the interior surface of said pump barrel, whereby said swab assembly is raised relative to said pump barrel causing hydraulic action to open said debris-trapping valve allowing sand and debris to enter said debris-receiving and trapping sub and the fluids within said pump barrel above said swab member to be discharged out through the fluid outlets near the top portion of said pump barrel and allowing more sand and debris to enter said debris-receiving and trapping sub and said pump barrel, and repeating the steps of raising and lowering said tubing string until the sand and debris are sufficiently removed from the well bore to continue normal drilling or completion operations, and selectively rotating said string of tubing when desired to break up and stir the sand and debris at the bottom of the well bore or when said penetrating device encounters an obstruction to break up the sand and debris at the bottom of the well bore and allow it to be sucked into the debris-receiving and trapping sub, and thereafter removing the string of tubing from the well bore.

* * * * *